United States Patent [19]

Smithdeal

[11] Patent Number: 4,771,553

[45] Date of Patent: Sep. 20, 1988

[54] BOOT INSERT

[76] Inventor: Charles D. Smithdeal, 8635 W. Third St., Suite 850, Los Angeles, Calif. 90048

[21] Appl. No.: 82,116

[22] Filed: Aug. 6, 1987

[51] Int. Cl.[4] ..... A43D 3/14

[52] U.S. Cl. ..... 36/1; 36/1.5; 36/50; 12/128 R

[58] Field of Search ..... 36/1, 1.5, 2 R, 2 A, 36/2 B, 50, 117, 132, 136; 223/98, 113; 220/355, 356, 359; 215/12.1; 12/128 R; 206/278

[56] References Cited

U.S. PATENT DOCUMENTS

| | | | |
|---|---|---|---|
| 337,539 | 3/1886 | Warner | 220/355 |
| 2,317,554 | 4/1943 | Risch | 215/12.1 |
| 3,218,737 | 11/1965 | Burtoff | 36/50 |
| 3,355,056 | 11/1967 | Fisch | 220/355 |
| 3,692,208 | 9/1972 | Croyle et al. | 220/355 |
| 3,749,232 | 7/1973 | Craig | 206/278 |
| 4,461,030 | 7/1984 | Knudsen | 36/2 R |
| 4,497,080 | 2/1985 | Inspector | 12/128 R |
| 4,514,915 | 5/1985 | Galetta | 36/1 |
| 4,516,409 | 5/1985 | Hobbs, Jr. et al. | 220/93 |
| 4,624,060 | 11/1986 | Maxwell | 36/1 |

FOREIGN PATENT DOCUMENTS

| | | | |
|---|---|---|---|
| 662408 | 9/1936 | Fed. Rep. of Germany | 223/113 |
| 563775 | 9/1958 | Canada | 220/355 |
| 43407 | 8/1960 | Poland | 220/355 |

*Primary Examiner*—Steven N. Meyers

*Attorney, Agent, or Firm*—Patrick F. Henry, Sr.

[57] ABSTRACT

A boot cover fits around the top of a boot and closes the gap or space between the top edge of the boot and the cover. In one form, the cover is made from plastic and has a groove that fits around the top edge of the boot. In another form, the cover comprises a deformable insert made of plastic, or like a bag filled with soft foam, plastic, with a skirt which can be removed to cover the opening at the boot edge.

11 Claims, 1 Drawing Sheet

BOOT INSERT

An insert for the open top of a boot to close the top during storage so as to prevent the entry of dirt and debris as well as insects, such as spiders or scorpions.

The insert includes a portion which covers the open top of the boot, together with a means for closing the edge of the boot. In one form the device may be molded from plastic to provide a boot top closure having an open channel which fits around the top of the boot. In another form, the insert into the top of the boot may be a deformable, 3-dimensional part which has a skirt that is pulled around the outside of the boot to close the gap between insert and the skirt.

Ordinarily, dress boots, hunting boots or riding boots are left open when not in use. This presents a problem whenever boots are left in places where dirt or debris can get inside the top of the boot, or even worse, insects such as scorpions or spiders can enter the boot and then sting the wearer after the boots are worn. There is therefore, a demand for a simple, expedient and inexpensive way to cover and close the top of a boot, or shoe. U.S. Pat. No. 3,218,737 discloses a way of closing a boot, but requires a permanent zipper and flap stitched in place.

The present invention discloses several different devices for closing the top of a boot during storage. In one form the device is a plastic molded or metal formed cap or closure which comprises a closure portion that extends and covers the entire top opening of the boot, together with a peripheral groove and lip portion that extends around the upper edge of the boot. In another form, the closure or cover for the boot is a 3-dimensional, tapered and deformable insert which may made from foam plastic or like a bag filled with some material, such as shredded foam, cotton or particulate material. An outer skirt is attached to the insert and may be pulled around the top of the outside of the boot.

An object of this invention is to provide a removable closure for the open top of a boot during storage so as to prevent the entry of unwanted, debris, insects and the like, and without modification to the boot.

An additional objective of this invention is to provide in one form an attractive closure for the boot which utilizes a fabric skirt that matches the material on the top of the 3-dimensional, deformable insert which fits down into the boot so as to maintain the shape of the top of the boot which remains the same and is not modified.

Still another advantage of the present invention resides in the inexpensive construction that lends itself to mass production and sale. Furthermore, according to the present invention the materials may be porous so as to provide for moisture evaporation from the boots and also may contain a dessicant, such as silica gel, to absorb moisture.

Other and further objects and advantages of this invention will become apparent upon reading the following description of the preferred embodiments, in conjunction with the accompaning drawings, wherein.

DESCRIPTION OF THE PREFERRED EMBODIMENTS

Figure 1:
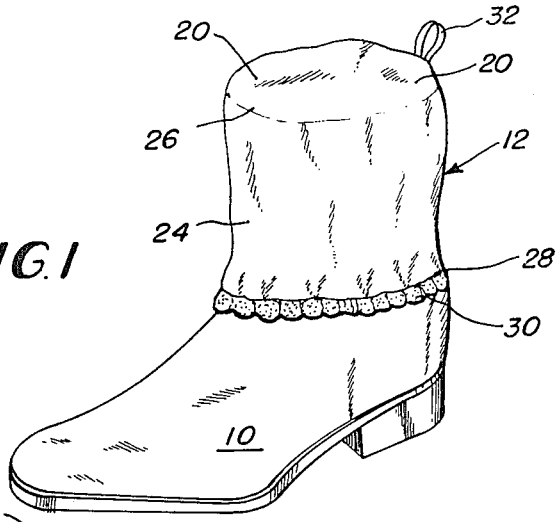
FIG. 1 is perspective view of a dress boot having one form of the present invention mounted thereon with the outside skirt in place.

The boot 10 does not by itself form any part of the invention and in the drawings there is shown a typical man's dress boot or jodpur-type boot which could also just as well be a hunting boot of any height, a Western or Cowboy boot, or a tall riding boot of any size and shape for men, women and children.

Figure 2:
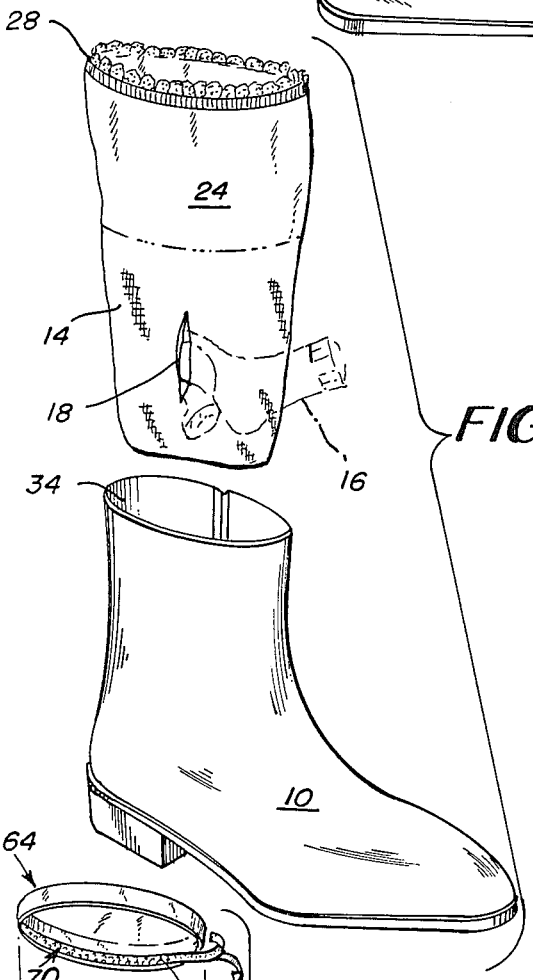
FIG. 2 is an exploded view of the boot in FIG. 1 with the device in position for insert or removal from the open top of the boot and illustrating how socks may be inserted through a slit in the insert.
Figure 3:
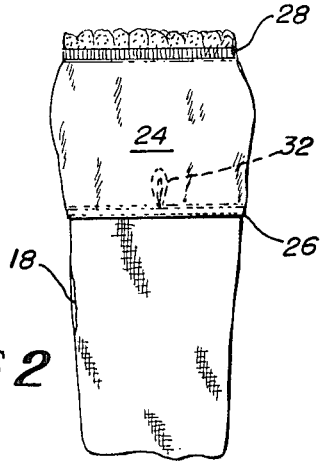
FIG. 3 is a front view of the device shown in FIG. 2.
Figure 4:
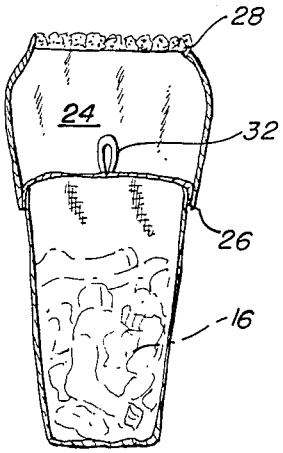
FIG. 4 is a view similar to FIG. 3, but in cross-section showing the skirt sewn into the center at a point where the upper and lower portions are joined.

The first form of the boot cover 12 comprises a 3-dimensional, deformable insert 14 which may be constructed like a tapered bag filled with some material such as synthetic or natural fibre, including cotton and the like, foam rubber, styrofoam, natural sponge, or even socks 16, which may be inserted and removed through a small slit 18. The top 20 of the insert 14 is covered by a cover 22 which is part of a skirt 24 stitched at 26 to the insert 14 forming an intregal construction having the movable skirt 24 which may be lifted to the extended position shown in FIG. 2, or pulled downwardly into the installed position shown in FIG. 1. Skirt 24 is stitched to insert 14 at 24 and is provided with an elastic hem 28, which maintains skirt 24 tightly in place to prevent the entry of debris and particularly dangerous insects, such as spiders and scorpions. The entire device 12 may be constructed from a decorative fabric material, including natural or synthetic material of blends of cotton and polyester made in patterns appropriate with Western or riding themes and may be provided with other decorative materials, such as lace 30 at hem 28. A loop 32 or a tassle on the top provides easy removal from the boot 10 as well as providing a convenient means of hanging the boot on a hook or hanger when not in use.

The insert 14 could be made from anything providing moderate stiffness with deformability or malleability to conform to the inside shape of the boot 12 while hoiding the boot wall out in its proper shape and to effectively seal against the outside of boot 12. Alternatively, the hem 28 could be made of a different material from the insert 14. The insert 14 could be made from cardboard, celluloid, plastic, thin metal, foam rubber, leather, or indeed almost any material which provides enough resilience and malleability to fit the inside of the boot 10 with sufficient resistence to prevent the boot from deforming or crinkling after the outside hem 28 has been moved into position so that there is a tight closing of the gap between the boot wall 34 and the insert 14. Also, a dessicant such as a silica solid or gel material may be placed inside the insert 14 through slot 18 to absorb moisture and also packets of deoderants may be placed inside insert 14 through slit 18.

Figure 5:
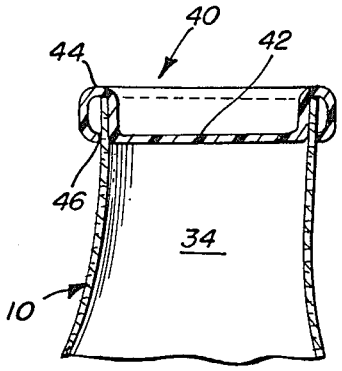
FIG. 5 is a cross-sectional, elevation view of a portion of a boot top showing a first modified form of the device.

In the alternative form, second embodiment of a boot cover 40, shown in FIG. 5, boot 10 has the upper edge thereof covered by a flat cover portion 42 which extends to form a peripheral rim 44 having a peripheral groove 46 therein which received the top edge of boot 10 to close same by means of the peripheral flange which fits around the top edge of boot 10 and covers and closes. Boot cover 40 may be molded from plastic in one piece at a very low cost and in different sizes for different sized boots for men, women and children.

Figure 6:
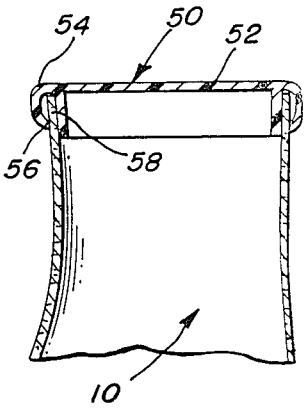
FIG. 6 is a partial end elevation view of a boot top showing a second, alternative form of the invention.

The alternative, third embodiment of a boot cover 50, shown in FIG. 6, is very similar to the embodiment shown in FIG. 5, except that the cover portion 52 is flush or straight with the plane across and including the top edge of the boot 10 rather than being recessed like the device 40 in FIG. 5. The device 50 includes an outer peripheral flange 54 and inner flange 56 forming a peripheral groove 58 in which is fitted the top edge of the boot 10 whereby the device 50 is a closure cap that is easily fitted on the top of the boot 10 in the same manner as the closure 40 in FIG. 5.

Figure 7:
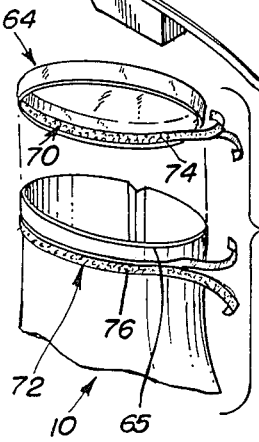
FIG. 7 is a partial perspective view of a third form of the invention using adhesive-backed "Velcro".
Figure 8:
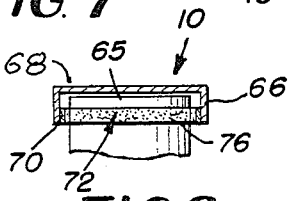
FIG. 8 is a cross-sectional view of the embodiment shown in FIG. 7.

In the fourth alternative embodiment shown in FIGS. 7 and 8, a removable cap 64, conforming in shape to the shape of the top edge 65 of boot 10, has peripheral flange 66 depending from the top 68 of cap 64 and the flange 66 fits around the top edge of the boot as seen in FIG. 8. A strip 70 of adhesive material, such as one part of a two-part Velcro (trademark) system, is attached to the outside of boot 10 in alignment with and near to top edge 65 for adherence to the other strip 72 of the two-part system which provides a selective means for adhering the cap 64 to the boot 10. The "Velcro" system comprising a strip 70 of looped members 74 engaged by barbed members 76 on strip 72. Strip 70 and 72 each has an adhesive back, optionally if desired with a removable cover (not shown), so that the strips 70 and 72 can be permanently attached in place.

While I have shown several embodiments of my invention for purpose of illustration, there are other forms of the invention which may be constructed and various alterations and departures which may be made in the preferred embodiments without departing from the scope of my invention as determined only by a proper interpretation of the appended claims.

What is claimed:

1. A removable cover for placement in the open top of a boot which has an opening defined by a peripheral top edge, comprising: a boot insert of deformable construction and a skirt on said insert movable into and out of position over the edge of the boot, said skirt extending around the peripheral top edge of the boot to close the top of the boot between the cover and the top edge of the boot.

2. The device claimed in claim 1 wherein said skirt has an elastic hem therein.

3. The device claimed in claim 2 wherein said insert has a slit therein whereby socks or other articles may be deposited to the inside of the insert.

4. In combination with the open top of a boot which has an opening defined by a peripheral top edge: a removable boot cover placed over said open top of said boot, wherein said cover includes a peripheral flange and groove on said cover for placement around and over the peripheral top edge of the boot, to close the open top of the boot between the cover and top edge of the boot.

5. The device claimed in claim 4 wherein said cover is recessed on said flange into the inside of the top of the boot.

6. The device in claim 4 wherein the cover is straight across the top of the boot and substantially even with the top edge.

7. In combination with the open top of a boot which has an opening defined by a peripheral top edge: a removable boot cover placed over said open top of said boot, wherein said cover is a cap placed over the open top of the boot, said cap having a depending, peripheral portion for placement around the peripheral top edge of the boot; a top cover portion over the open top of the boot; and detachable adhering means between the cap and said boot.

8. The device in claim 7 wherein said adhering means comprises an adhesive material on said peripheral portion and complimentary adhesive material on said boot.

9. The device in claim 8 wherein said adhesive material on one of said peripheral portion and boot has loops thereon and the other has barbs thereon.

10. The device in claim 8 wherein said adhering means is "VELCRO" hook and pile-type fastening means.

11. The device in claim 9 wherein said adhesive material on said periperal portion and said boot each has a removable cover thereon and an adhesive back whereby said cover may be removed and said back stuck to said boot respectively.

* * * * *